United States Patent [19]

Little

[11] Patent Number: 4,782,784

[45] Date of Patent: Nov. 8, 1988

[54] MOTORIZED BOAT-MOUNTED SIGNALING DEVICE FOR WATER SKIERS

[76] Inventor: Cheryl G. Little, 14718 Burbank Blvd., Van Nuys, Calif. 91401

[21] Appl. No.: 941,633

[22] Filed: Dec. 15, 1986

[51] Int. Cl.[4] ..... G08B 5/26

[52] U.S. Cl. ..... 116/303; 116/173; 116/313; 116/28 R; 340/127; 340/286 R; 441/69

[58] Field of Search ..... 116/173–175, 116/209, 28 R, 284, 294, 303, 313, 319; 441/69, 68; 340/286, 127, 132, 133, 573, 574; 74/96

[56] References Cited

U.S. PATENT DOCUMENTS

| | | | |
|---|---|---|---|
| 2,783,451 | 2/1957 | Stout | 340/127 |
| 3,018,474 | 1/1962 | Cluck et al. | 441/69 |
| 3,735,724 | 5/1973 | Miller | 116/303 |
| 3,786,778 | 1/1974 | Palmer et al. | 116/313 |
| 3,798,631 | 3/1974 | Langford | 441/69 |
| 3,848,244 | 11/1974 | Young et al. | 116/303 |
| 4,122,796 | 10/1978 | Pressler et al. | 116/173 |

*Primary Examiner*—William A. Cuchlinski, Jr.
*Assistant Examiner*—Patrick R. Scanlon
*Attorney, Agent, or Firm*—John J. Posta, Jr.

[57] ABSTRACT

A device for use on ski boats is disclosed which provides a warning to other boats in the area that a downed water skier is in the water by using a motorized electrical device to raise a flag, either automatically when a skier falls and the tow rope is released, or manually when triggered by the motor boat operator or passenger. The device electrically raises the warning flag, and maintains it in an upright position until the skier grasps the tow rope handle, or until the operator releases the manual trigger switch, at which time the flag is returned to a lowered position by a spring. The system of the present invention may be used with one or more water skiers, and uses a positive switch indicator rather than depending on the degree tension in the tow rope.

2 Claims, 2 Drawing Sheets

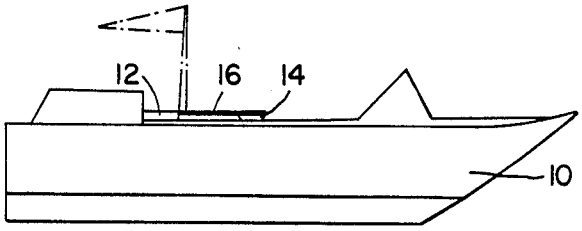
FIG. 1
FIG. 3
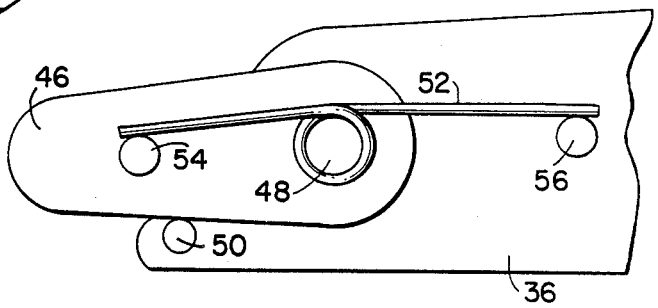
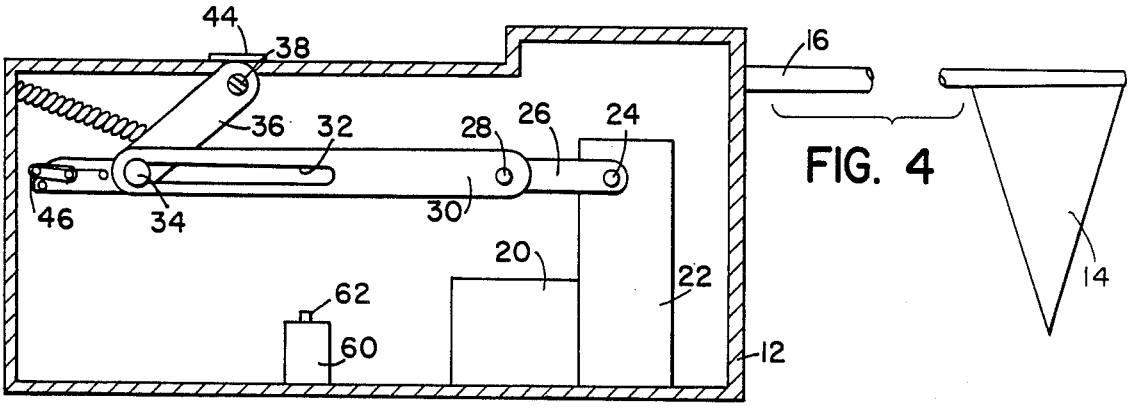
FIG. 4
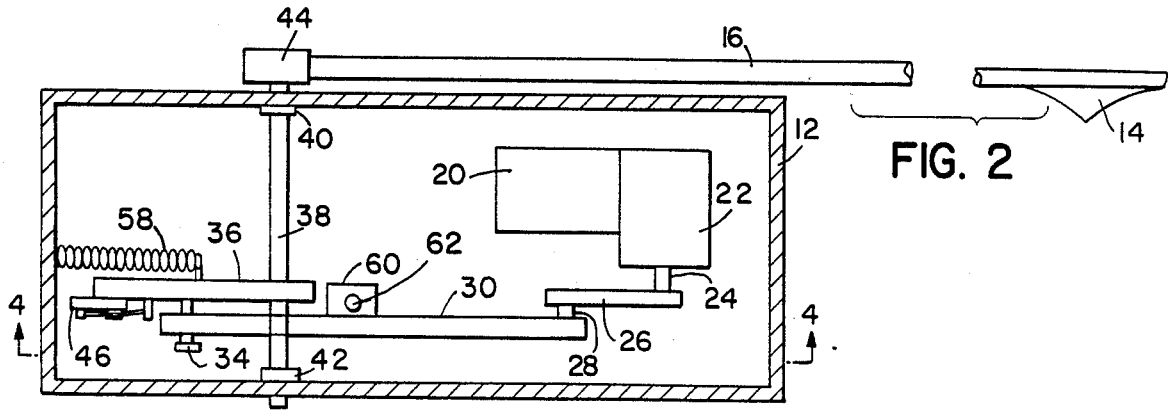
FIG. 2

MOTORIZED BOAT-MOUNTED SIGNALING DEVICE FOR WATER SKIERS

BACKGROUND OF THE INVENTION

Field of the Invention

The present invention relates generally to a device for automatically raising a warning flag or pennant deployed on a motor boat when a water skier towed by the boat falls and releases the tow rope, and more particularly to a motorized electrical device for dependably raising a flag either automatically when the tow rope is released, indicating that the water skier has fallen into the water, or manually when triggered by the motor boat operator or passenger.

With the ever-increasing popularity of water sports the number of water skiers has steadily increased, bringing ever larger numbers of water skiers and ski boats to a relatively fixed number of recreation areas. While water skiers are sufficiently visible while skiing to prevent all but the most careless of boating accidents, the sport presents one extremely dangerous situation-namely that of the downed water skier.

It will be recognized that even the most skilled of water skiers will occasionally fall, and that the norm of skill in the sport as displayed in recreational areas is far less, meaning that each ski boat is likely to have relatively frequent incidences in which the skier being towed from the boat is down. The relatively great speed of motor boats and the relatively poor visibility of a downed water skier in the water makes spotting a downed water skier a difficult task requiring concentration and a high degree of care. In most instances the only visible indication of the presence of a downed water skier is a bobbing head in the water, and at least in some instances the water skier may be briefly under the water making the water skier extremely difficult to spot. A downed water skier struck by a boat is a potential fatality, due to the speed and force with which a boat is likely to strike the water skier, likely in the head, which is presented to the boat due to its location on the surface of the water.

A common precaution in the sport is the use of an observer seated in the stern of the ski boat, who may quickly signal the driver when the water skier falls and direct the driver to stop and return to the site where the water skier is floating. In fact, in many local jurisdictions the presence of an observer is required by law. While the presence of an observer will ensure that the ski boat returns promptly to the site of a downed water skier, such an observer in not of great utility in warning other boats in the area that the water skier is down. The observer may attempt to wave off boats approaching the site of the downed water skier, but will in all likelihood not be heard or understood by operators of other boats due to normal noise level. The observer may inadvertently act as a distraction to operators of other boats, and may in fact increase the chance that these operators of other boats will not see the downed water skier.

One early attempt to present a warning to other boats in the area involved attaching a warning device to the water skier, to thereby give the water skier greater visibility when downed. Unfortunately, the only way such a device could be readily visible was if it was attached to the water skier's head. Needless to say, relatively few water skiers care to damage their image by wearing cumbersome paraphenalia on their heads.

This strategy has therefore proved undesirable, and has never achieved great usage.

The signaling device that has shown the most promise is the warning flag or pennant, which is raised manually or otherwise when the water skier falls to warn operators of other boats that a downed water skier is in the vicinity. In fact, in areas under its jurisdiction, the United States Coast Guard has required that the ski boat display a warning flag indicating the presence of a water skier in the water following a fall or other incident. As with any rule of its type, adherence to this rule is directly proportional to the convenience of complying. If a flag is aboard and if it is convenient to do so, the observer or operator will display the flag. Otherwise, no warning signal is given to protect the downed water skier.

As might be expected, a better potential solution to the problem was shortly forthcoming in the form of both more convenient and automatic devices to deploy a warning flag from a ski boat when the water skier was down. By way of example, the former is illustrates in U.S. Pat. No. 4,122,796, to Cattell et al., which teaches a device in which a flag and pole is permanently mounted onto a ski boat at a location near the operator's position. The pole is movable between two locking positions, one a down position and the other an upright position. This device is a step in the right direction since it ensures that a flag is conveniently located near the operator; however, if the operator forgets to raise the flag, or deliberately does not raise it, there will be no warning flag displayed.

The other potential solution is even more desirable, in that devices which fall into the category designed to automatically raise a warning flag when the water skier is down in the water will be more likely to ensure that a warning flag is raised to indicate that the water skier is in down in the water. These devices are essentially all mechanical in nature, and have a spring means which acts to urge the flag into an upright position. The flag is retained a downward position by the tension of the ski rope, and when a water skier falls and drops the rope, the flag is raised.

One examples of such a devices is found in U.S. Pat. No. 3,602,188, to Penaflor, which describes a flag which pops up out of an essentially vertical cylinder when the tension on a tow rope is released. The Penaflor device also has an optional warning light on the driver's panel. A second example is shown in U.S. Pat. No. 3,735,724, to Miller et al., which teaches a flag mounted on a pole which swings from horizontal to vertical position when tension on the tow rope is released. An additional example is found in U.S. Pat. No. 4,545,320, to Lewis et al., which shows both a manual flag and an automatic flag similar to the Miller et al. device.

Such devices have several problems inherent in their design. First, if the water skier is caught on the tow rope the flag will not deploy, even though the skier in completely in the water. In some circumstances, even though the water skier has released the tow rope the drag of the rope in the water may prevent the flag from being deployed, especially as the device gets older and exhibits some degree of wear.

If multiple water skiers are being towed behind a single boat, either only one of the tow ropes will operate the flag, or the flag will not be operated until all the skiers are down simultaneously. Finally, it is apparent that in devices relying on tension in the tow rope to keep the flag down, the flag will be fully deployed when the skier is getting ready to be towed, or even when the boat is not being used for water skiing. The flag would have to be fastened down by rope or the like to keep it out of the deployed position.

It is therefore apparent that there exists a need for an automatic flag warning system which operates positively and dependably without requiring the lack of tension in the tow rope. The system must be automatic, and not depend on selective actuation by the operator of the ski boat or a passenger in the boat; however, the system should have provision for being actuated by the operator of the boat in emergency situations. The system must be usable with a plurality of water skiers, and must raise the flag when any one of the water skiers is down in the water. Finally, the solution to the aforementioned problems should accomplish all the objects above enumerated without incurring any relative disadvantages.

SUMMARY OF THE INVENTION

The disadvantages and limitations of the background art discussed above are overcome by the present invention. With this invention, an electrically operated device is used to overcome the disadvantages of the mechanical systems described above. Since as a practical matter all ski boats have an electrical system, electrical power is available to operate the system of the present invention. The present invention uses a motor to positively drive a pole containing the flag into an upright or vertical position from its normal stored position, which is essentially horizontal.

The flag is driven into the upright position in response to one of two signals. First the water skier's tow rope handle has built into it a normally closed switch. When the water skier grips the tow rope handle, the switch is opened. If the water skier falls or for any other reason releases the tow rope handle, the tow rope switch will close, causing the motor to drive the flag into its upright position.

It is possible as an option to use a plurality of tow ropes equipped with like switches. The switches would be in a parallel configuration, so if any one water skier being towed by the boat were to release the tow rope handle, the flag would be raised. The second signal capable of operating the flag is an optional normally open switch at the operator's location, typically on the control panel of the ski boat. When the operator desires to raise the flag, the switch may be closed to operate the motor to raise the flag.

When the tow rope switch or switches are gripped by the water skier or skiers, and the operator switch is open, the flag will return to its lowered position automatically, since it is biased in the lowered position. The motor drive to raise the flag ensures that wear in the system will not impede the raising of the flag, since the motor has more than sufficient power to raise the flag.

The automatic flag warning system of the present invention operates positively and dependably without ever requiring a determination of tension in the tow rope, and in fact is completely independent of tension in the tow rope. The system is completely automatic, and does not depend on selective actuation by the operator of the ski boat or a passenger in the boat. In addition, the system has provision for being actuated by the operator of the boat in an emergency situation. The system is easily and conveniently usable with a plurality of water skiers, and raises the flag when any one of the water skiers is down in the water. No relative disadvantages are incurred by the system of the present invention while obtaining the advantages previously enumerated, making it a highly desirable improvement to the art.

DESCRIPTION OF THE DRAWINGS

These and other advantages of the present invention are best understood with reference to the drawings, in which:

FIG. 1 is a somewhat schematic view of a system constructed according to the present invention installed on a ski boat;

FIG. 2 is a top view of the actuating mechanism used for driving the warning flag, with the top of the housing removed;

FIG. 3 is an enlarged view of the spring-loaded pawl of the actuating mechanism shown in FIG. 2, which is used to retain the warning flag in an upright position as long as power is applied to the actuating mechanism;

FIG. 4 is a cutaway side view of the actuating mechanism shown in FIG. 2, with the warning flag in a stowed or lowered position;

DETAILED DESCRIPTION OF THE PREFERRED EMBODIMENT

Figure 5:
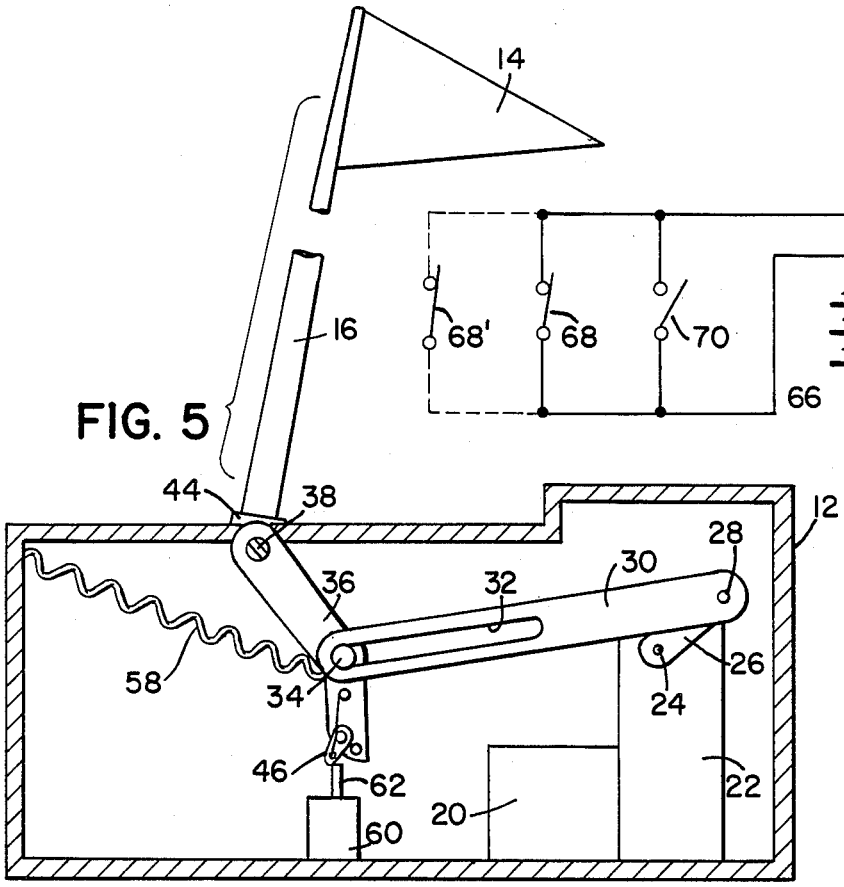
FIG. 5 is a cutaway side view like that of FIG. 4, but with the flag being driven to a nearly upright position, and the spring-loaded pawl about to move past the retaining solenoid core.

The preferred embodiment of the present invention is shown in FIG. 1 installed onto a ski boat 10. A housing 12 containing the actuating mechanism is mounted onto the ski boat 10, with a warning flag 14 mounted on one end of a pole 16, the other end of which pole 16 is attached to the housing 12 and the mechanism therein. The pole 16 is in a horizontal position when the flag 14 is not to be deployed, and moves to an essentially vertical position as shown in phantom lines to deploy the flag 14.

Moving now to FIGS. 2 and 4, one possible arrangement for the actuating mechanism contained within the housing 12 is shown in detail. A motor 20 is mounted on the bottom of the housing 12, and drives a gear reducer 22 having an output shaft 24. When an operating signal is sent to the motor 20, it will drive the output shaft 24 of the gear train 22 through one complete revolution, and then stop. The motor 20 will not be operated again until the operating signal disappears and then is sent once again to the motor 20.

Connected to and rotating with the output shaft 24 is an output arm 26. On the end of the output arm 26 not connected to the output shaft 24 is a pin 28 rotatably linking the output arm 26 to a drive arm 30. The end of the drive arm 30 not connected to the output arm 26 has as elongated longitudinal aperture 32 therein. A pin 34 extends through the elongated aperture 32 in the drive arm 30 and is attached to a driven arm 36 at a location intermediate the ends of the driven arm 36. The drive arm 30 is slideable throughout the length of the elongated aperture 32 on the pin 34.

One end of the driven arm 36 is fixedly attached to drive a shaft 38, which is mounted in bearings 40, 42 at the ends thereof to the housing 12. One of the ends of the shaft 38 extends outside the housing 12, where it is attached to a mounting block 44, which in turn is attached to the pole 16. It may be appreciated that the driven arm 36, the shaft 38, the mounting block 44, the pole 16, and the flag 14 move in an integral fashion such that when the driven arm 36 is driven approximately ninety degrees in a counter-clockwise direction the flag 14 will move from a lowered position to a fully upright position.

Referring now to FIG. 3, at the end of the driven arm 36 opposite the end connected to the shaft 38 a pawl 46 is rotatably mounted with a pin 48. The pawl 46 extends beyond the end of the driven arm 36, and at its furthermost position is restrained in counterclockwise movement by a pin 50 on the driven arm 36. The pawl 46 is urged in a clockwise direction into position against the pin 50 by a spring 52, mounted on the pin 48 and acting against a pin 54 on the pawl 46 and a pin 56 on the driven arm 36.

Referring again to FIGS. 2 and 4, a spring 58 is connected at one end to the driven arm 36 at a location away from the end of the driven arm 36 connected to the shaft 38, preferably at an intermediate location on the driven arm 36. The other end of the spring 58 is connected to the housing 12, in a way whereby the spring urges the driven arm 36 to move the flag 14 into a fully downward position as shown in FIG. 4.

Completing the construction of the actuating mechanism is a solenoid 60, which, when energized, drives a solenoid core 62 out of the solenoid 60. The solenoid 60 is mounted on the bottom of the housing 12, with the solenoid core 62 moving in an upward direction when the solenoid 60 is energized. When the solenoid 60 is energized and the solenoid core 62 is extended, and the driven arm 36 is moved in a counter-clockwise direction, the pawl 46 will move in a clockwise direction to allow the pawl 46 to move past the solenoid core 62. The pawl will then move back against the pin 50, and the driven arm 36 will not be able to move in a clockwise position as urged by the spring 58 until the solenoid 60 is deenergized and the solenoid core 62 retracts.

Figure 7:
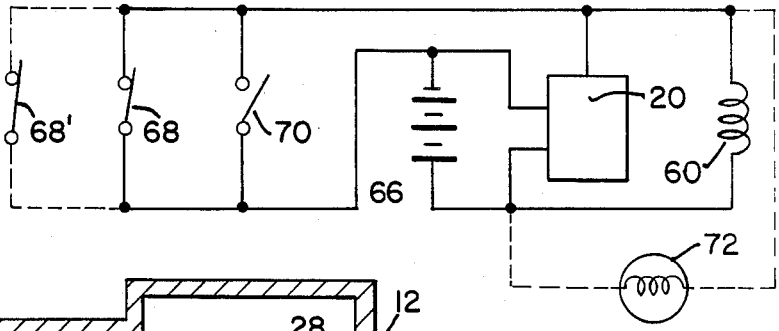
FIG. 7 is an electrical schematic of the system shown in the previous Figures, with the optional additional tow rope switch and the operator warning lamp being shown in dotted lines.

Referring now to FIG. 7, the electrical schematic of the system is shown. A battery 66, most likely the battery of the ski boat 10, powers the system. Power from the battery 66 is always supplied to the motor 20, which, as stated above will operate the output arm 26 for one revolution when a signal is received, and will not operate again until the signal is removed and once again applied. For examples of such a motor, the reader is directed to automobile windshield wiper systems having a "mist" feature, whereby upon a switch being actuated, the wipers will move through one cycle (360 degrees) and will not operate again until the switch is released and actuated again.

A normally closed switch 68 contained in the tow rope handle (FIGS. 8 and 9) will be opened by pressure of the water skier's hand on the handle and will not close until such time as the tow rope handle is released by the water skier. Additional switches 68', etc., may be installed in parallel if more than one water skier is to be towed by the ski boat 10. A normally open switch 70 may be used by the operator of the ski boat 10 to set an emergency signal as desired. If desired a warning lamp 72 may be mounted in the operator's view, such as in the dashboard of the ski boat 10. When any of the switches 68, 68', or 70 are closed, the system will be operated, causing the motor 20 to be driven, the solenoid 60 to be actuated, and the warning lamp 72 to be lit.

Figure 6:
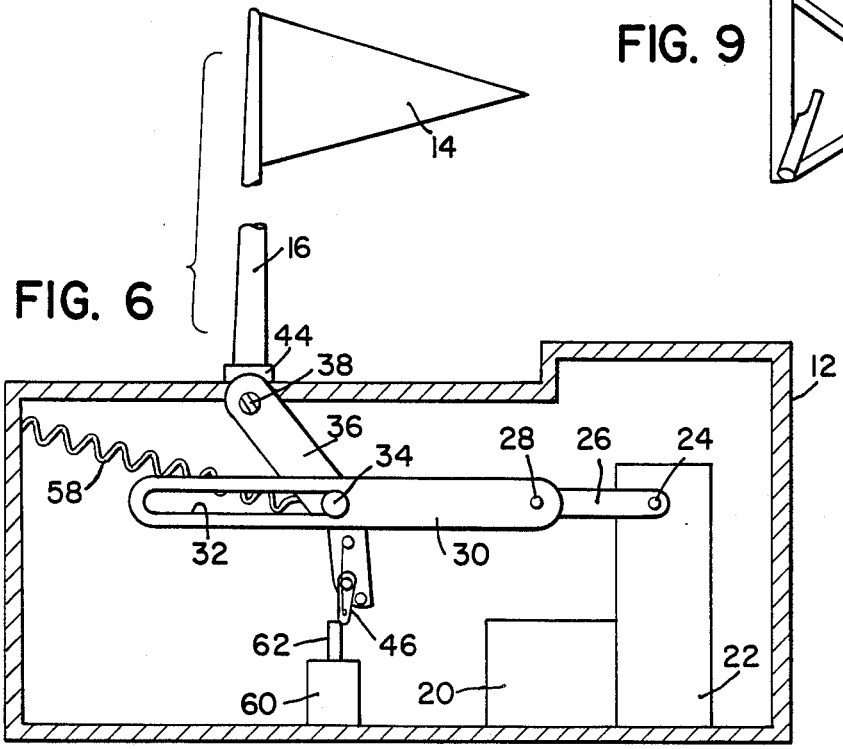
FIG. 6 is a cutaway side view like those of FIGS. 4 and 5, but with the flag retained in an upright position by the solenoid core and the motor drive mechanism returned to the stored position.

The operation of the device will now be described with reference to FIGS. 7 and, in turn, 4, 5, and 6. Until one of the switches 68, 68', or 70 closes, the system will be in the position shown in FIG. 4. When one of the switches 68, 68', or 70 is closed, the motor 20 will drive the output arm 26 in a clockwise direction, pulling the drive arm 30 and the driven arm 36 as shown on FIG. 5, raising the flag 14. The motor 20 will continue to operate, pulling the pawl 46 past the solenoid core 62, which is fully extended. The motor 20 will then return to its rest position, bringing the output arm 26 and the drive arm 30 to their original positions. The driven arm 36, however, will remain in position as shown in FIG. 6, with the solenoid core 62 locking the flag 14 in the upright position until all of the switches 68, 68', and 70 are once again open, at which time the solenoid core 62 will retract, releasing the pawl 46 and allowing the driven arm 36 to move in a clockwise direction as urged by the spring 58, and allowing the flag 14 to be lowered.

Figure 8:
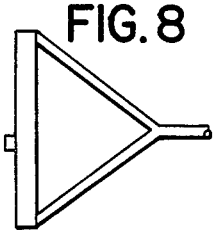
FIG. 8 is a view of one possible arrangement for a tow rope handle containing a switch therein.
Figure 9:
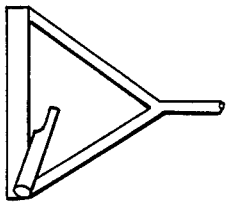
FIG. 9 is a view of another possible arrangement for a tow rope handle containing a switch therein.

Referring finally to FIGS. 8 and 9, examples of the switches as mounted in the tow rope handles are shown. In FIG. 8, a push button switch 80 is mounted in a handle 82. In FIG. 9, a lever switch 84 is mounted in a handle 86. Both of the switches 80 and 84 are normally closed switches which are opened by pressure of a water skier's hand or hands on the handles 82, 86, respectively. The switches 80 and 82 are connected to the actuating system in the housing 12 by wires running along the tow ropes.

The system of the present invention thus operates positively and dependably, and is completely independent of tension in the tow rope. The system is automatic, and also has provision for being actuated by the operator of the ski boat 10 in an emergency situation. The system is usable with one or more water skiers, and raises the flag 14 when any water skiers towed by the ski boat 10 is down in the water. The present invention obtains the advantages previously enumerated while incurring no relative disadvantages, making it a valuable improvement over the art.

Although an exemplary embodiment of the present invention has been shown and described, it will be apparent to those having ordinary skill in the art that a number of changes, modifications, or alterations to the invention as described herein may be made, none of which depart from the spirit of the present invention. All such changes, modifications, and alterations should therefore be seen as within the scope of the present invention.

What is claimed is:

1. A warning device for use on a ski boat to indicate the presence of a downed water skier in the water, comprising:

a pole mounted at one end thereof for angular rotation with respect to said boat between a first substantially horizontal position and a second substantially vertical position, said pole having a warning flag attached to the other end thereof;

means for generating an electrical signal when said water skier falls;

electrical motor means for driving said pole from said first position to said second position when said electrical signal is generated; and pole retraction means for returning said pole from said second position to said first position when said electrical signal is no longer generated, wherein said pole retraction means comprises:

biasing means for biasing said pole toward said first position; and means for retaining said pole in said second position until said electrical signal is no longer generated, wherein said retaining means comprises:

a shaft supporting said pole at said one end;

an arm extending from said shaft;

a pawl mounted on the end of said arm; and a solenoid having a solenoid core extending therefrom when said electrical signal is generated, said pawl slipping over said solenoid core when said pole is raised, said pawl catching on said solenoid core, which is extended to prevent said pole from being lowered until said electrical signal is no longer generated.

2. A warning device as defined in claim 1, wherein said biasing means comprises:

a spring urging said pole toward said first position.

* * * * *